US005727512A

United States Patent [19]

Hutchins

[11] Patent Number: 5,727,512

[45] Date of Patent: Mar. 17, 1998

[54] INTERNAL COMBUSTION ENGINE

[75] Inventor: William Richard Hutchins, Kenilworth, England

[73] Assignee: Rover Group Limited, Warwick, England

[21] Appl. No.: 575,725

[22] Filed: Dec. 18, 1995

[30] Foreign Application Priority Data

Dec. 20, 1994 [GB] United Kingdom ..... 9425716

[51] Int. Cl.[6] ..... F02F 1/00

[52] U.S. Cl. ..... 123/193.3; 123/195 R

[58] Field of Search ..... 123/195 R, 193.3, 123/193.5

[56] References Cited

U.S. PATENT DOCUMENTS

| | | | |
|---|---|---|---|
| 3,895,868 | 7/1975 | Castarede | 123/195 R |
| 4,013,058 | 3/1977 | Hafner et al. | 123/195 R |
| 4,304,199 | 12/1981 | Formia et al. | 123/254 |
| 4,370,951 | 2/1983 | Pomfret | 123/195 R |
| 4,587,933 | 5/1986 | Shaw | 123/41.67 |
| 4,637,354 | 1/1987 | Tominaga et al. | 123/195 R |
| 4,712,517 | 12/1987 | Anno et al. | 123/41.74 |
| 4,736,956 | 4/1988 | Yoshijima et al. | 277/22 |
| 5,190,003 | 3/1993 | Voigt | 123/195 R |
| 5,209,197 | 5/1993 | Melchior | 123/193.2 |
| 5,463,991 | 11/1995 | Krotky et al. | 123/195 R |
| 5,562,073 | 10/1996 | Van Bezeij et al. | 123/195 R |

FOREIGN PATENT DOCUMENTS

| | | |
|---|---|---|
| 0 061 778 A1 | 3/1982 | European Pat. Off. . |
| 0 525 967 A1 | 6/1992 | European Pat. Off. . |
| 0 591 737 A1 | 9/1993 | European Pat. Off. . |
| 670 682 | 3/1929 | France . |
| 992 865 | 9/1944 | France . |
| 2 464 364 | 5/1980 | France . |
| 42 06 165 A1 | 9/1992 | Germany . |
| 406000 | 2/1934 | United Kingdom . |
| 2 099 075 | 12/1982 | United Kingdom . |
| 2 168 750 | 12/1985 | United Kingdom . |

*Primary Examiner*—David A. Okonsky
*Attorney, Agent, or Firm*—Davis and Bujold

[57] ABSTRACT

An internal combustion engine comprises an iron block 2 and an aluminium head 3 held together by bolts 6. The bolts 6 extend through oil drainage passages 8 in the head and through bores 9 in the block and engage with the block at a point substantially spaced from the head/block interface. The increased length of the bolts 6 allows them to stretch to accommodate the relatively large expansion of the head as the engine warms up. Good thermal contact is provided between the bolts and the water jacket of the engine so that the bolts warm up quickly.

16 Claims, 6 Drawing Sheets

INTERNAL COMBUSTION ENGINE

FIELD OF THE INVENTION

The present invention relates to improvements in the performance of internal combustion engines during warm-up and is particularly useful in diesel engines.

BACKGROUND OF THE INVENTION

It can be advantageous to make an engine having a head made of a material, such as aluminium, which has a relatively high coefficient of thermal expansion compared to conventional iron based alloys. This can cause a problem in that the fasteners used to hold the head onto the block are generally of an iron based alloy and have to accommodate a large amount of thermal expansion in the aluminium head.

SUMMARY OF THE INVENTION

Where the block is made of a material of a relatively low coefficient of thermal expansion, such as a conventional iron based alloy the above problem can be overcome for some or all of the fasteners by extending them down a long way into the block. This means that a large proportion of the length of those fasteners is surrounded by the block so that when the temperature of the head and block increase the expansion in the head can be accommodated by stretching of the entire length of the fastener.

Accordingly the present invention provides an internal combustion engine comprising a cylinder block made of a first material, a cylinder head made of a second material, and a plurality of fasteners which extend through the cylinder head and into the block and secure the head to the block, wherein the second material has a greater coefficient of thermal expansion that the first material and the fasteners engage with the block at a point substantially spaced from the interface between the block and the head, and the portion of the fasteners between the point of engagement and the interface is free to stretch.

Said fasteners preferably comprise all of the fasteners which hold the head to the block, but may comprise only some of them.

The first material may be iron or an alloy containing a large proportion of iron, and the second material may be aluminium or an alloy containing a large proportion of aluminium.

The fasteners are preferably in close thermal contact with a water jacket in the block. This helps to speed up the heating of the fasteners. This can be achieved by having a relatively thin wall separating the fasteners from the water jacket.

Preferably the fasteners are also in close thermal contact with oil drainage passages in the block. This may be achieved by arranging the fasteners to extend through said oil drainage passages or to extend through bores in the block which are separated from said oil drainage passages by a single wall, which is preferably not significantly thicker than the fasteners.

The fasteners may be in pairs, each pair comprising two fasteners on opposite sides of the block, with two end pairs and a number of central pairs equally spaced from the axes of two of the cylinders. In this case all the central pairs of fasteners are preferably in close thermal contact with the oil and water. More preferably at least some of the fasteners making up the two end pairs are also in close thermal contact with the oil and water, though this will not always be possible.

DESCRIPTION OF THE PREFERRED EMBODIMENTS

Figure 1:
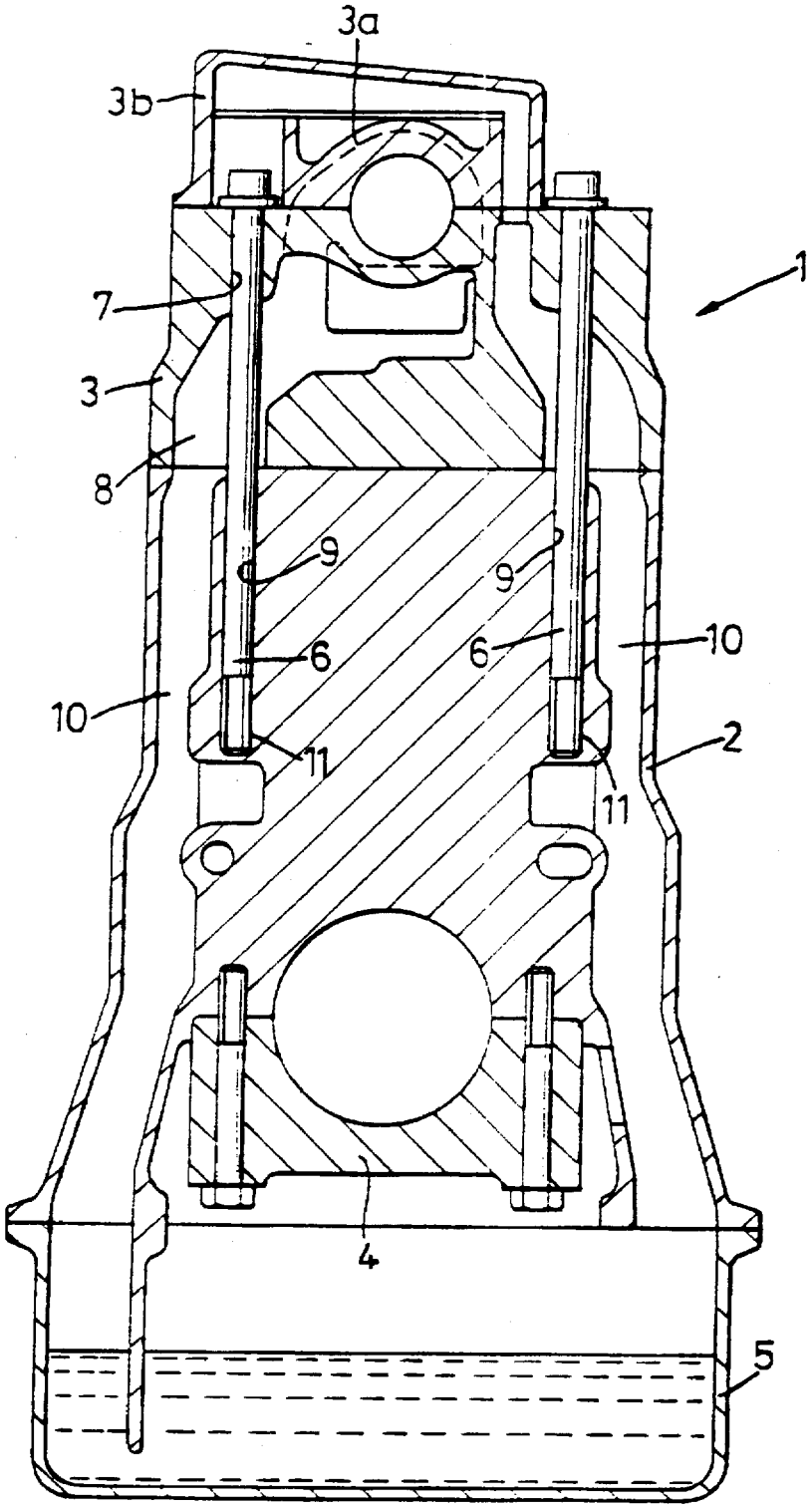
FIG. 1 is a section through an engine according to a first embodiment of the present invention.

Referring to FIG. 1, an engine 1 comprises a cast iron cylinder block 2, a cast aluminium cylinder head 3, a cam cover 3*a*, a cover 3*b*, a bearing ladder 4 and a sump 5. The head 3 is attached to the block 2 by means of cylinder head fastening bolts 6. Oil drainage and breather passages have their upper part 8 defined in the head 3 and their lower part 10 defined in the block 2. They extend from the cam region down to the sump 5 and allow oil to drain from the cam region down to the sump, and blow-by gasses to flow up through the head 3 to the cover 3*b*. The cylinder head bolts 6 extend through bores 7 in the head, then through the oil drainage and breather passages 8 in the head and then down through bores 9 in the block 2 parallel to oil drainage and breather passages 10 in the block 2. The threaded ends 11 of the bolts engage with the block 2 at a point about one third of the way down the block 2, thus closing the bottoms of the bores 9. The tops of the bores 9 open into the oil drainage and breather passages 8 at a position level with the top of the cylinder block 2.

Figure 2:
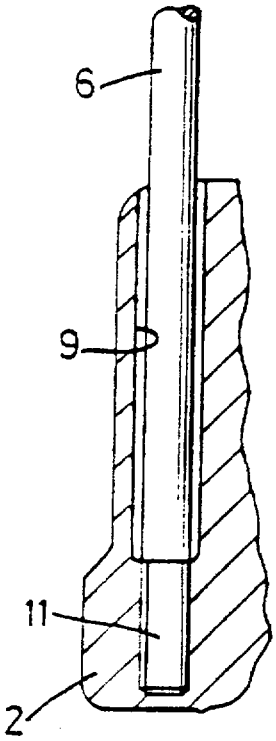
FIG. 2 is an enlargement of part of FIG. 1.

As can be seen clearly in FIG. 2 the bores 9 in the block 2 are slightly wider than the bolts 6 and there is therefore a gap surrounding the portion of the bolts which extend into the block 2.

As the engine warms up the part of the bolts 6 extending through the oil drainage and breather passages 8, 10 are heated by the oil in them. Oil collects in the bores 9 around the bolts and helps to transfer heat from the passages 10 in the block 2 to the parts of the bolts 6 which are in the bores 9. The oil in the bores also helps to transfer heat from the water jacket (not shown) to the bolts. Because good thermal contact with at least one of the oil drainage and breather passages and the water jacket is provided over most of the length of the bolts 6, they can be heated up very quickly. The heating of the bolts is described in more detail below with reference to FIGS. 3 to 6.

Referring to FIGS. 3 to 6, according to the second embodiment of the invention, an internal combustion engine comprises a cast iron cylinder block 22, an aluminium cylinder head, a bearing ladder 26, a crankshaft 28 and a sump. The head and sump are not shown but correspond to those in FIG. 1. The cylinder block 22 is formed as a single iron casting and includes cylinder walls 34*a* , 34*b* 34*c* 34*d* which define the bores 36*a* 36*b* 36*c* 36*d* in which the pistons (not shown) travel, and an outer wall structure 38. Between the cylinder walls 34 and the outer wall structure 38 is a water jacket 40 which is a space which can be filled with water and which separates the cylinder walls 34 from the outer wall structure 38 over most of the height of the cylinders.

The cylinder walls 34 are formed as four parallel hollow cylinders 42 each being joined to the one(s) next to it down a line parallel to their axes 44.

The outer wall structure 38 has ten bores 46 for receiving the steel fasteners 47 which attach the head 24 to the block 22. These bores 46 extend vertically down through the block 22 from its upper surface 48 to a point about two thirds of the way down the cylinder bores 36, and are threaded at their lower ends 50. They are arranged in two rows of five bores, one on either side of the cylinder bores 36, and are aligned with the joins 49 between the cylinder walls 34 or the outer edge of the walls 34*a* 34*d* of the end cylinders. For each of the central three pairs of fasteners 47 shown in FIGS. 4 and 5, oil drainage passages 52 extend down through the block 22 on the outside of the fastener bores 46 from the upper surface 48 of the block down to the sump 30. The walls 53 which surround the fastener bores 46 and separate them from the oil drainage passages 52 and water jacket 40 are relatively thin and each of them forms a vertical tube-like section of the block with the water jacket 40 on one side and one of the oil drainage passages 52 on the other. The tube-like sections formed by the walls 53, together with narrow webs 53*a* on either side of them, separate the oil drainage passages 52 from the water jacket 40, from the top of the block 2 down to the bottom of the fasteners 47. The fasteners 47 are therefore in good thermal contact with the oil drainage passages and the water jacket. This helps to ensure that, when the engine is warming up, the fasteners 47 are heated firstly by the water in the water jacket, which heats up fastest, and then also by the oil in the drainage passages 52 as that heats up. The fasteners 47 therefore heat up and expand almost as fast as the block 22. This helps them to accommodate the relatively large expansion of the aluminium head 24. Also the whole of the length of the fasteners above the threads is free to stretch to accommodate the expansion of the aluminium head 24.

The water jacket 40 stops slightly above the level of bottom of the cylinder bores 36. On either side of the cylinder bores 46, between the bottom of the water jacket 40 and the bottom of the cylinder bores 46 is section 54, 55 Of the block 22 which runs along substantially the full length of the block. At the outer edge of one of these sections 54 is a passageway 56 in the form of a drilled oil gallery for supplying oil to the crankshaft bearings 57, and at the outer edge of the other 55 is another passageway 58 which is part of the oil drainage and breather system and is formed during the casting of the block. Just inside these passageways 56, 58 a solid section 60, 61 of metal extends straight through the block over substantially its whole length. These solid sections 60, 61 form longitudinal support sections which strengthen the block.

Below the bottom of the cylinder bores 46 the block 22 forms the upper part of the crankcase 62 of the engine. This comprises an outer wall 64 partly defining the crankcase, with lateral bulkheads 66 which extend across the crankcase dividing it into four bays 68, one below each cylinder bore 36. The lateral bulkheads 66 also form the upper half of the crankshaft bearings 57, the lower half of which is formed by the bearing ladder 26. They are solid so that the bays 68 are completely separated above the center line 72 of the crankshaft 28. The lateral bulkheads extend upwards between the bottom part of the cylinder bores 36 and thereby form transverse support sections 74 which extend across the block 22 between the longitudinal support sections 60, 61.

Figure 3:
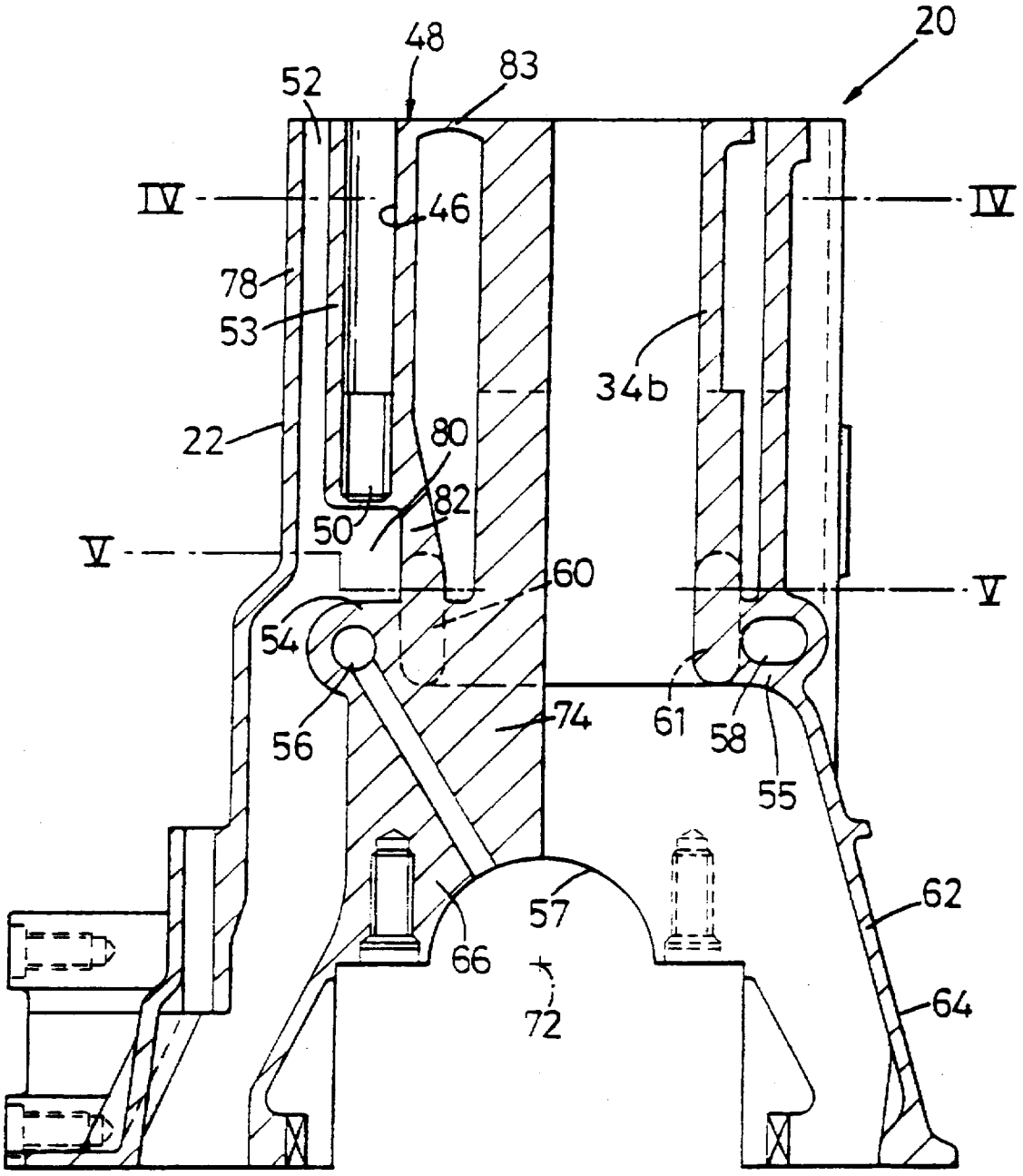
FIG. 3 is a transverse section through a block of an engine according to a second embodiment of the invention.
Figure 4:
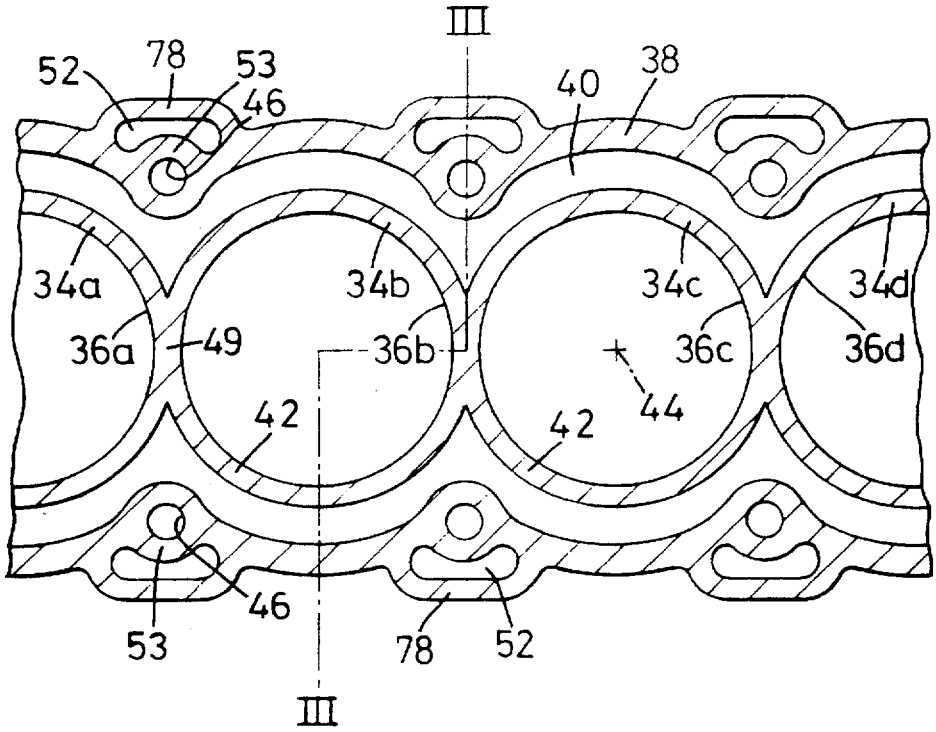
FIG. 4 is a horizontal section on line IV—IV of FIG. 3.
Figure 5:
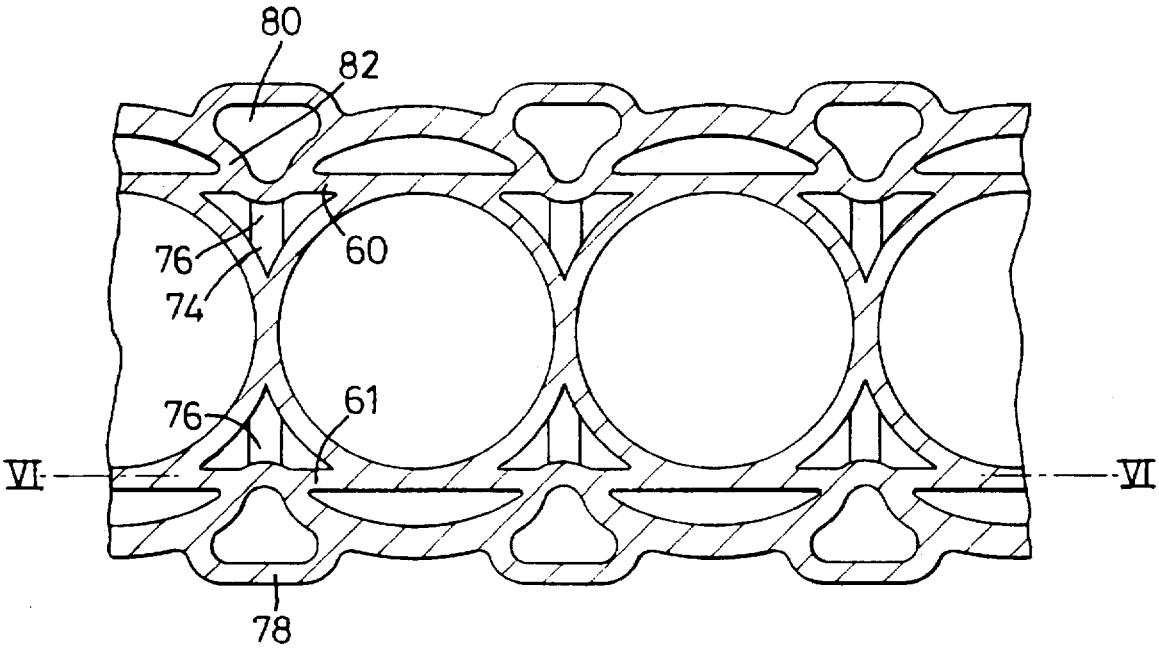
FIG. 5 is a horizontal section on line V—V of FIG. 3.

As can be seen in FIG. 3, the threaded lower ends 50 of the fastener bores 46 are above the ends 76 of the transverse support sections 74 where they are joined to the longitudinal support sections. However the outer walls 78 of the oil drainage passages 52 extend down below the lower ends 50 of the fastener bores 46, and the oil drainage passages 52 widen out to form a chamber 80 which extends directly below the lower ends 50 of the fastener bores 46. The result of this is that a column 82, formed at its upper end by the outer wall 78 of the oil drainage passage 52 and part of the wall 53 of the fastener bore 36 (see FIG. 4) and at its lower end by the wall 88 of the chamber 80 (see FIG. 5), provides a strong interconnection between the threaded lower end 50 of each of the fastener bores 36 and the longitudinal and transverse support sections 60, 61, 74 at their point of intersection.

Figure 6:
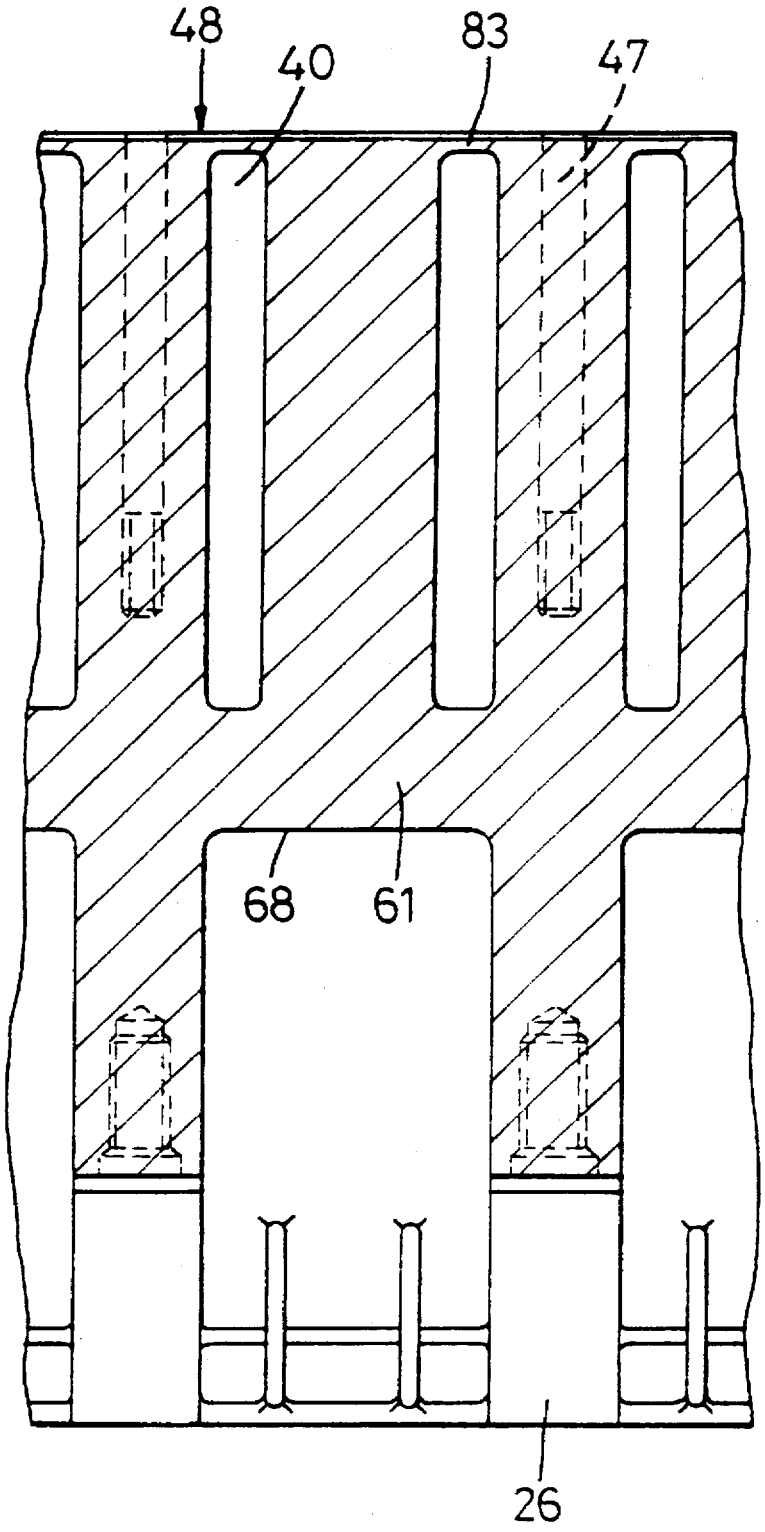
FIG. 6 is a longitudinal section on line VI—VI of FIG. 4.
Figure 7:
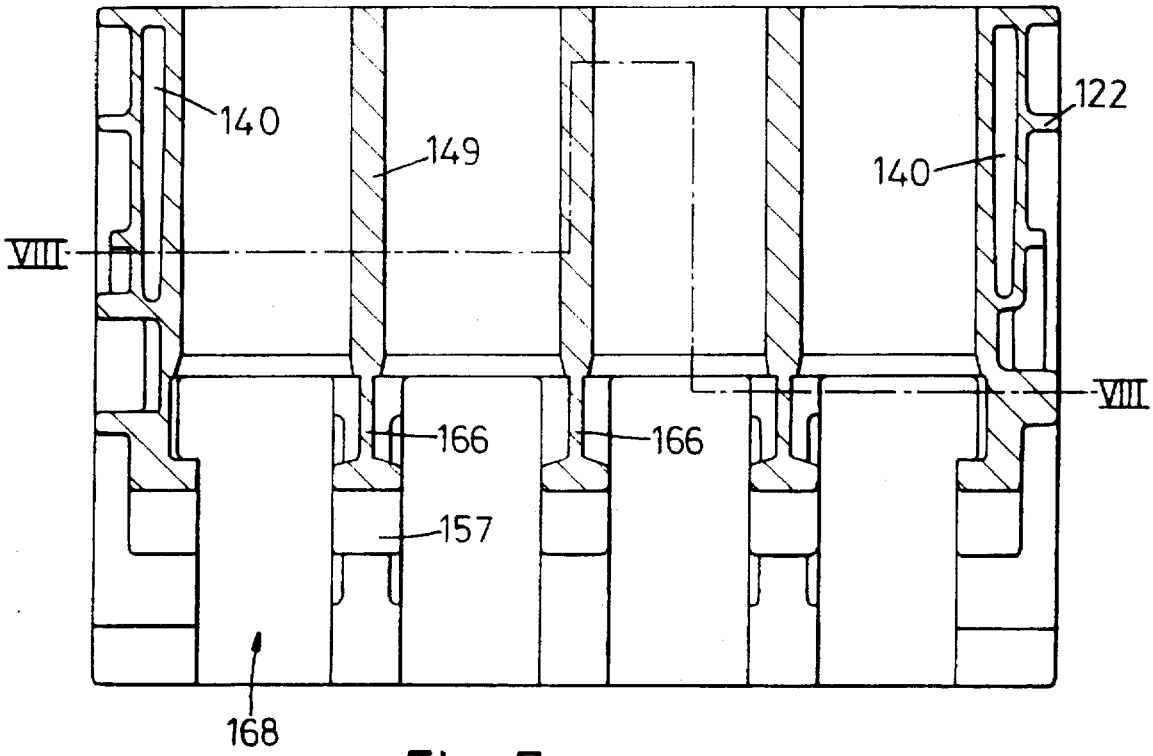
FIG. 7 is a longitudinal section through the block of an engine according to a third embodiment of the invention.
Figure 8:
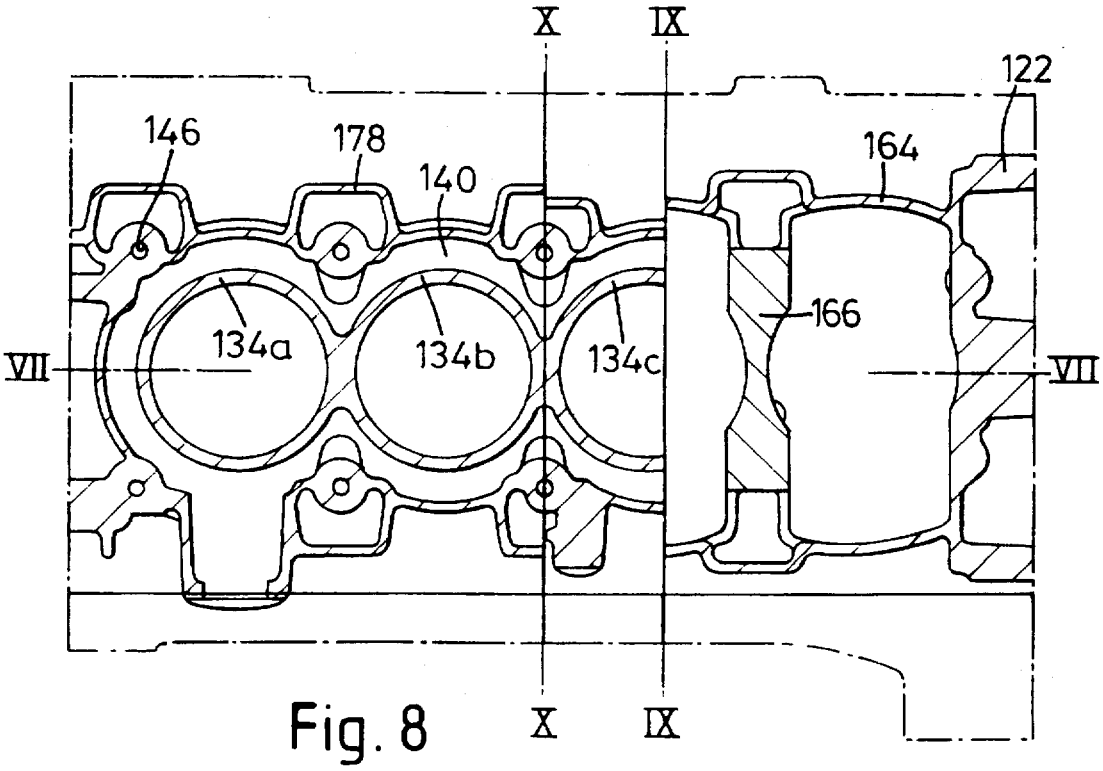
FIG. 8 is a horizontal section on line VIII—VIII of FIG. 7.
Figure 9:
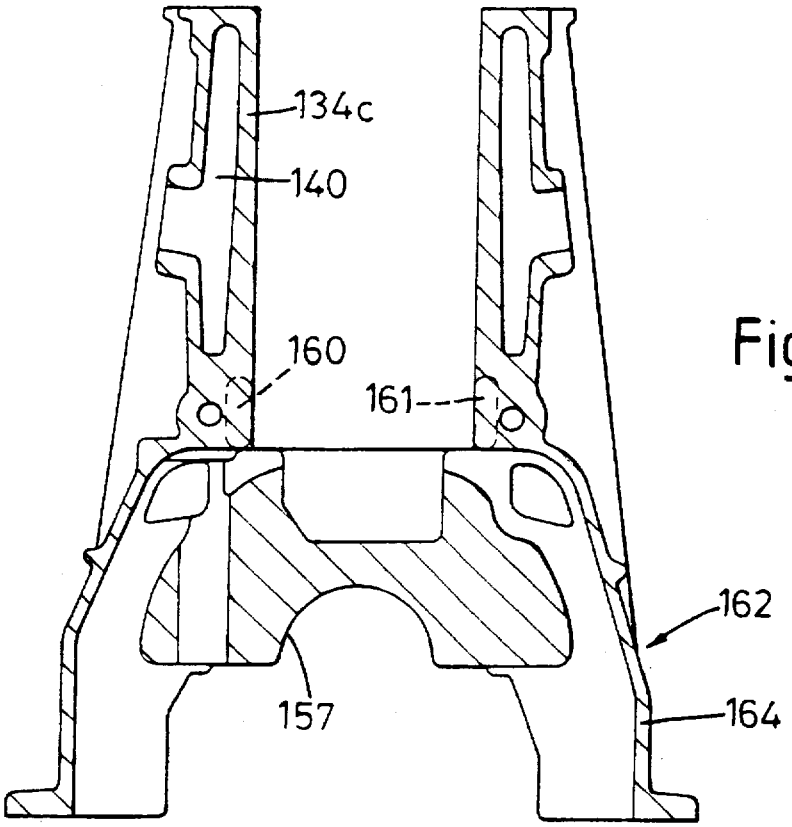
FIG. 9 is a transverse section on line IX—IX of FIG. 8.
Figure 10:
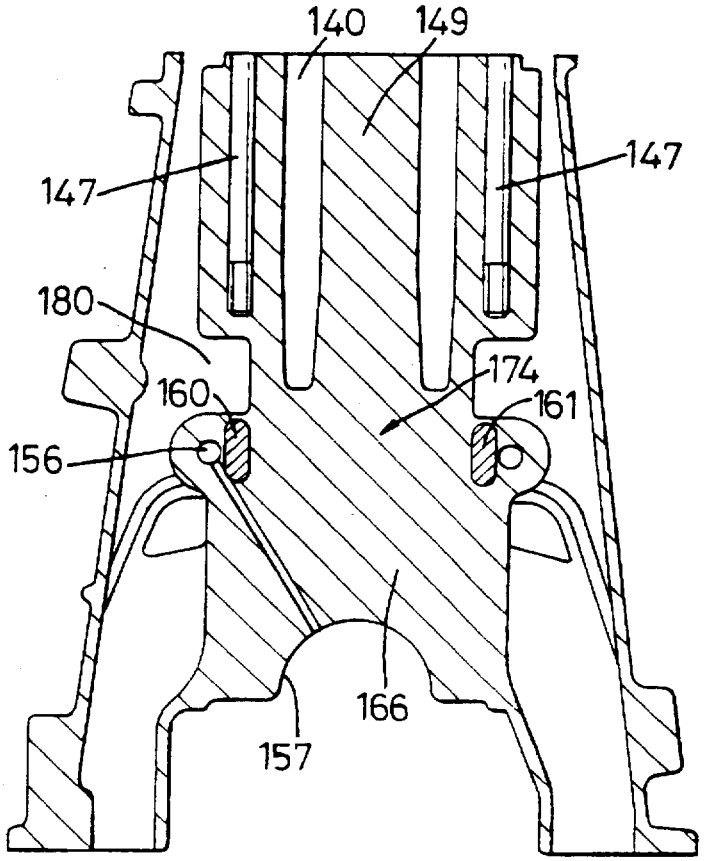
FIG. 10 is a transverse section on line X—X of FIG. 8.

As can be seen in FIG. 6, a large part of the upper surface 48 of the block is covered over by a relatively thin layer of metal 83 which seals the water jacket 40. However the stiffness of the top of the block caused by this layer is less than the stiffness at the level of the of the longitudinal and transverse support sections 60, 61, 74. Because of this forces tend to be transmitted between the fasteners and the cylinder walls 34 through the support sections rather than through the top of the block.

The second embodiment of the invention, the cylinder block of which is shown in FIGS. 7 to 10 is similar to the first embodiment, and corresponding features are indicated by the same reference numerals preceded by a 1.

What is claimed is:

1. An internal combustion engine comprising a cylinder block made of a first material, a cylinder head made of a second material, and a plurality of fasteners which extend through the cylinder head and into the block, and secure the head to the block, wherein; the second material has a greater coefficient of thermal expansion than the first material; the fasteners engage with the block at a point substantially spaced from the interface between the block and the head; the portion of the fasteners between the point of engagement and the interface is free to expand; the engine has oil drainage passages and a water jacket defined therein; and the engine has fastener bores defined therein through which the fasteners extend and which are wider in diameter than the fasteners and have a remote end which is closed so that oil from the drainage passages can collect in the fastener bores around the fasteners thereby to bring the fasteners into close thermal contact with the water jacket.

2. An engine according to claim 1 wherein the fasteners have a coefficient of thermal expansion similar to that of the first material.

3. An engine according to claim 1 wherein said first material contains at least a large proportion of iron, said second material contains at least a large proportion of aluminium, and the fasteners are made of a material containing at least a large proportion of iron.

4. An engine according to claim 1 wherein the fasteners are in close thermal contact with the oil drainage passages, over at least a part of their length.

5. An engine according to claim 4 wherein the fasteners extend, for a part of their length, through said oil drainage passages.

6. An engine according to claim 1 wherein said engine includes at least one single wall, each of said single walls separating one of said oil drainage passages from one of said fastener bores.

7. An engine according to claim 1 including substantially tube-like sections of the block each defining at least a part of a respective fastener bore through which one of the fasteners extends, the engine having oil drainage passages defined therein, at least one of said fastener bores has, over at least a part of its length, one of said oil drainage passages and the water jacket on opposite sides thereof.

8. An engine according to claim 1 wherein the fastener bores have respective upper ends which open into said drainage passages.

9. An internal combustion engine comprising a cylinder block being made of a first material, a cylinder head being made of a second material, and a plurality of fasteners extending through said cylinder head into said block and securing said head to said block;

wherein said second material has a greater coefficient of thermal expansion than said first material; said fasteners engage with said block at a point spaced from an interface between said block and said head; a portion of said fasteners, between a point of engagement and the interface, is free to expand; said engine has oil drainage passages, a water jacket, and fastener bores defined therein, and said fasteners extend into said fastener bores, said fastener bores have a diameter larger than a diameter of said fasteners, and said fastener bores are each partially surrounded by said water jacket, said fastener bores have a remote end which is closed so that oil from said oil drainage passages can collect in said fastener bores around said fasteners, whereby said fasteners are in close thermal contact with said water jacket.

10. An engine according to claim 9 wherein said fasteners have a coefficient of thermal expansion similar to that of said first material.

11. An engine according to claim 9 wherein said first material is iron, said second material is aluminum, and said fasteners contain iron.

12. An engine according to claim 9 wherein said engine includes at least one single wall, each said single wall separates one of said oil drainage passages from one of said fastener bores.

13. An engine according to claim 9 including substantially tube-like sections of said block each defining at least a portion of a respective fastener bore through which one of said fasteners extends, said engine has oil drainage passages defined therein, at least one of said fastener bores has, over at least a portion of its length, one of said oil drainage passages and said water jacket on an opposite side thereof.

14. An engine according to claim 9 wherein said fasteners are in close thermal contact with said oil drainage passages over at least a portion of their length.

15. An engine according to claim 14 wherein said fasteners extend, for a portion of their length, through said oil drainage passages.

16. An engine according to claim 15 wherein said fastener bores have respective upper ends which open into said oil drainage passages.

* * * * *